US010183298B2

(12) United States Patent
Walling et al.

(10) Patent No.: US 10,183,298 B2
(45) Date of Patent: Jan. 22, 2019

(54) MANUFACTURING APPARATUS

(71) Applicant: The Procter & Gamble Company, Cincinnati, OH (US)

(72) Inventors: David William Walling, Cincinnati, OH (US); Lu Yao, Beijing (CN); Enjun Cheng, Beijing (CN); Gbenga Segun Showole, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/837,009

(22) Filed: Dec. 11, 2017

(65) Prior Publication Data

US 2018/0099287 A1 Apr. 12, 2018

Related U.S. Application Data

(62) Division of application No. 14/639,253, filed on Mar. 5, 2015.

(30) Foreign Application Priority Data

Mar. 7, 2014 (WO) ..... PCT/CN2014/073047

(51) Int. Cl.
*B02C 4/40* (2006.01)
*B05C 11/04* (2006.01)
*C11D 13/20* (2006.01)

(52) U.S. Cl.
CPC ..... *B02C 4/40* (2013.01); *B05C 11/048* (2013.01); *C11D 13/20* (2013.01)

(58) Field of Classification Search
CPC ..... B02C 4/40; C11D 13/20; B05C 11/048
USPC ..... 425/223, 225, 229, 230; 264/39; 15/256.51
See application file for complete search history.

(56) References Cited

U.S. PATENT DOCUMENTS 1,481,417 A 2/1923 Cove
1,762,043 A * 6/1930 Ayres ..... C11D 13/20 15/256.5
1,933,837 A * 11/1933 Arnold ..... D21G 3/005 15/256.51
2,054,115 A * 9/1936 Abrams ..... B29C 41/26 118/415
2,082,819 A * 6/1937 Beccard ..... B02C 4/40 15/256.51

(Continued)

FOREIGN PATENT DOCUMENTS

JP 2001-103801 A 4/2001
WO WO 03/060231 A1 7/2003

OTHER PUBLICATIONS

International Search Report and Written Opinion of the International Searching Authority, PCT/CN2014/073047, dated Nov. 26, 2014, 12 pages.

(Continued)

*Primary Examiner* — Timothy Kennedy

(57) ABSTRACT

The present invention relates to a manufacturing apparatus comprising a polymer blade for scraping soap adhered to a roll mill used to make bar soaps. The manufacturing apparatus can be used to manufacture bar soaps, particularly Zinc Pyrithione (ZPT) containing bar soaps, that is characterized by enhanced discoloration resistance and/or improve antimicrobial effect.

7 Claims, 7 Drawing Sheets

(56) References Cited

U.S. PATENT DOCUMENTS 2,732,773 A * 1/1956 Smith ..... D21G 3/005 15/256.51
2,847,698 A * 8/1958 Ritterson ..... A47L 13/08 15/256.5
2,890,473 A * 6/1959 Scott ..... B21B 28/04 118/261
3,097,390 A * 7/1963 Thaler et al. ..... A21C 3/02 15/256.51
3,229,662 A * 1/1966 Means ..... B05C 11/044 118/126
3,645,200 A 2/1972 Craddock et al.
3,711,888 A * 1/1973 Dunlap ..... D21G 3/005 118/261
4,241,691 A * 12/1980 Hopfe ..... B01D 29/6469 101/365
4,434,522 A * 3/1984 Linzberger ..... B02C 4/40 101/157
4,906,335 A * 3/1990 Goodnow ..... B05C 11/042 118/261
4,939,551 A * 7/1990 Hashiyama ..... G03G 21/0029 399/351
5,279,710 A * 1/1994 Aikawa ..... D21G 3/005 15/256.51
5,638,751 A * 6/1997 Daetwyler ..... B41F 9/1072 101/157
5,820,893 A 10/1998 Robertson, IV
5,983,798 A * 11/1999 Iijinna ..... B41F 31/20 101/169
6,269,556 B1 * 8/2001 Kallqvist ..... E01H 5/062 37/233
7,108,766 B1 * 9/2006 Eskelinen ..... D21G 3/005 162/111
8,202,395 B2 * 6/2012 Eriksson ..... D21G 3/04 162/111
2002/0174966 A1 * 11/2002 Brauns ..... B32B 5/28 162/280
2004/0099405 A1 5/2004 Hardy
2005/0160551 A1 * 7/2005 Kochenrath ..... B29C 39/42 15/256.51
2006/0180291 A1 * 8/2006 Rata ..... D21G 3/005 162/281
2009/0206562 A1 * 8/2009 Podolsky ..... A63C 1/02 280/11.14
2011/0220461 A1 * 9/2011 Kirschner ..... B65G 45/16 198/499
2018/0099287 A1 4/2018 Walling et al.

OTHER PUBLICATIONS

Supplementary International Search Report, PCT/CN2014/073047, dated May 20, 2016, 8 pages.
Lewis, Properties of crosslinked ultra-high-molecular-weight polyethylene, Biomaterials, vol. 22, pp. 371-401 (2001).
UHMW (Ultra High Molecular Weight Polyethylene), Poly-Tech Industrial, Inc., http://www.polytechindustrial.com/products/plastic-stock-shapes/uhmw.polyethylene (2018).

* cited by examiner

MANUFACTURING APPARATUS

FIELD OF THE INVENTION

The present invention relates to a manufacturing apparatus comprising a polymer blade for scraping soap adhered to a roll mill used to manufacture bar soaps.

BACKGROUND OF THE INVENTION

Scraper or Doctor blades made from metallic material (e.g., carbon steel, stainless steel) are well-known in the art. During the bar soap making process, soap pellets/noodles are passed through roll mills and compressed into "thin flakes". The blade is used to scrape the thin flakes that adhered to the roll mills to form "compacted flakes", which are then further refined and extruded into bar soaps.

A surprising and unexpected challenge was discovered when using a metal blade to manufacture bar soaps containing Zinc Pyrithione (ZPT), a broad-spectrum anti-microbial active. ZPT-containing soap flakes are typically white or light colored. It was discovered that unwanted metals found in the metal blade can transfer into the soap and/or onto the soap surface and complex with pyrithione to form a dark colored pyrithione precipitate that can cause significant "discoloration" (e.g., gray, green, blue or purple colors) (see FIG. 1A). This discovery was unexpected since the ZPT-containing soap flakes come in contact with the metal scraper for a very short duration (e.g., less than $1/100^{th}$ sec). As shown by FIG. 2, the resultant discoloration may adversely affect the overall aesthetics of the ZPT-containing bar soaps and may give consumers a negative impression of the shipment or storage conditions or that the ZPT-containing bar soaps may be of inferior quality.

Additionally, ZPT instability in bar soaps can pose a problem. Metal ions can also be introduced into the bar soap manufacturing process as impurities in raw materials, or metallic parts of other manufacturing equipments (e.g., roll mills, pipes, nozzles, etc.). It is believed that the oxidative reaction involving transition metal cations from the metal blade may further aggravate ZPT instability and accelerate oxidative loss over time. As a result, there can be a noteable reduction of the anti-microbial property of ZPT-containing bar soaps made using a metal blade.

A solution would be to substitute the metal blade with plastic material. However, many plastic material such as, for example, polycarbonate (e.g., carbon fiber blades), are generally hard and therefore tend to be brittle, and likely will not perform well as doctor blades. The concern is that brittle plastics can chip and crack and pieces of the material from the plastic blades may end up getting into the soap as foreign. Therefore, it would not be suitable to substitute any sort of plastic material for the metal blade.

Thus, there is a need for an improved manufacturing apparatus for manufacturing bar soaps, preferably ZPT-containing bar soaps. In particular, the need is for a manufacturing apparatus comprising a non-metallic blade for scraping soap adhered to a roll mill. The need also exists for a process for manufacturing a ZPT-containing bar soap that will not discolor through the use of the manufacturing apparatus. It is also desirable that the bar soap manufactured using this manufacturing apparatus will generally retain a significant portion of its anti-microbial properties.

SUMMARY OF THE INVENTION

In a first aspect, the present invention is directed to a manufacturing apparatus for scraping soap adhered to a roll mill. Specifically, the present invention is directed to a manufacturing apparatus comprising: (i) a polymer blade and (ii) a housing supporting the polymer blade. The polymer blade with a scraping surface having a scraping edge contacting the surface of the roll mill. The housing having a compacting surface intersecting the scraping surface at an intersection, wherein the intersection is opposing the scraping edge, and wherein the compacting surface and the scraping surface forms a facing angle θ (theta) from about 30° to about 80°.

In another aspect, the present invention provides for a process for manufacturing a bar soap, which includes the step of: (a) mixing one or more ingredients of a soap in a mixer; (b) milling the mixed ingredients over one or more roll mills; (c) scraping the milled ingredients adhered to the roll mill with a manufacturing apparatus according to the present invention; and (d) extruding the scraped ingredients to form a bar soap.

These and other features of the present invention will become apparent to one skilled in the art upon review of the following detailed description when taken in conjunction with the appended claims.

BRIEF DESCRIPTION OF THE DRAWINGS

While the specification concludes with the claims particularly pointing out and distinctly claiming the invention, it is believed that the invention will be better understood from the following description of the accompanying figures in which like reference numberals identify like elements, and wherein:

DETAILED DESCRIPTION OF THE INVENTION

It is to be understood that the scope of the claims is not limited to the specific apparatuses, methods, conditions or parameters described and/or shown herein, and that the terminology used herein is for the purpose of describing particular embodiments by way of example only and is not intended to be limiting of the claimed invention.

Also, as used in the Specification including the appended claims, the articles "a", "an", and "the" mean "one or more."

As used herein, the term "about" when placed before a numerical value "X" refers to an interval extending from 10% of X, preferably 5% of X, and even more preferably to an interval extending from 2% of X.

As used herein, the term "Bar soaps" refers to solid or semi-solid articles for washing, bathing, and cleaning that contain either soap surfactants and/or synthetic surfactants, as described hereinafter. A bar soap as used herein is not limited to a bar shape but can have any regular or irregular shape, including but not limited to: cubic, rectangular, spherical, oval, cylindrical, pyramidal and the like. The bar soaps of the present invention are not limited to any volume, but can be characterized, for non-limiting example, by a volume ranging from about 1 $cm^3$ to about 1,000 $cm^3$, more preferably from about 10 $cm^3$ to about 500 $cm^3$, and most preferably from about 50 $cm^3$ to about 200 $cm^3$, and a weight ranging from about 0.5 g to about 5 Kg, more preferably from about 1 g to about 1 Kg, and most preferably from about 10 g to about 500 g.

As used herein, any of the terms "comprising", "having", "containing", and "including" means that other parts, steps, etc. which do not adversely affect the end result can be added. Each of these terms encompasses the terms "consisting of" and "consisting essentially of". Unless otherwise specifically stated, the elements and/or equipments herein are believed to be widely available from multiple suppliers and sources around the world.

All percentages, parts and ratios are based upon the total weight of the bar soaps, unless otherwise specified. All such weights as they pertain to listed ingredients are based on the active level and, therefore do not include carriers or by-products that may be included in commercially available materials. The components, including those which may optionally be added, as well as methods for preparation, and methods for use, are described in detail below.

All ratios are weight ratios unless specifically stated otherwise. All temperatures are in Celsius degrees (° C.), unless specifically stated otherwise.

Manufacturing Apparatus

Figure 1A:
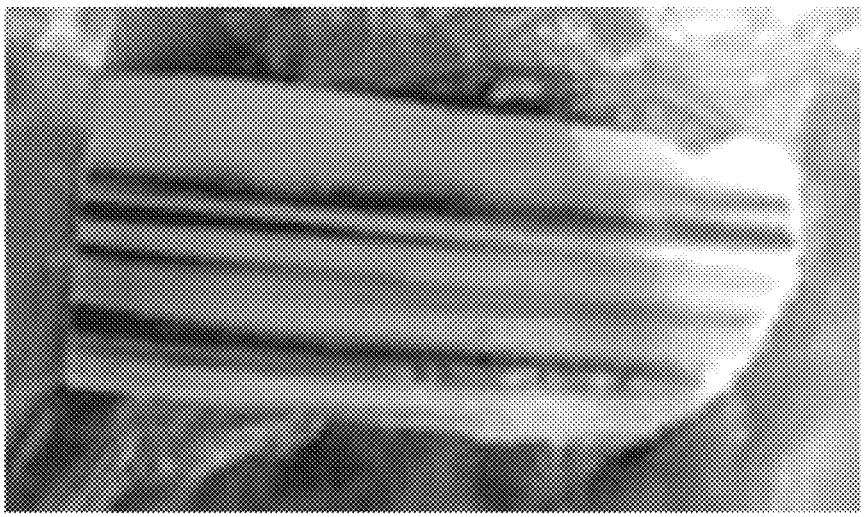
FIG. 1A is a photo of a compacted flake of ZPT-containing soap scraped from a roll mill (100) using a metal blade of the prior art. The colored lines represent the discoloration due to the reaction of the ZPT with metal ions.
Figure 1B:
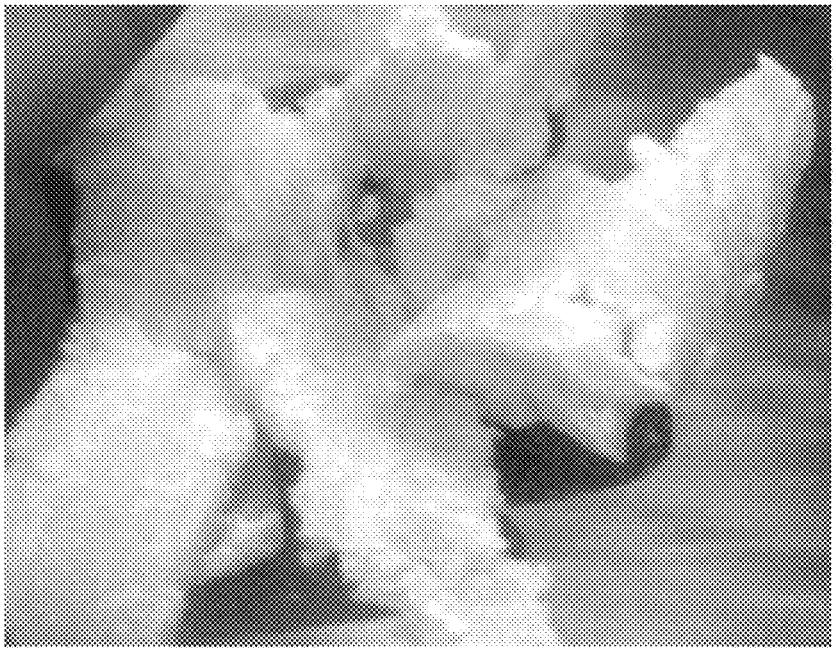
FIG. 1B is a photo of compacted flakes of ZPT-containing soap scraped from a roll mill (100) using a polymer blade (10) of the present invention.
Figure 2A:
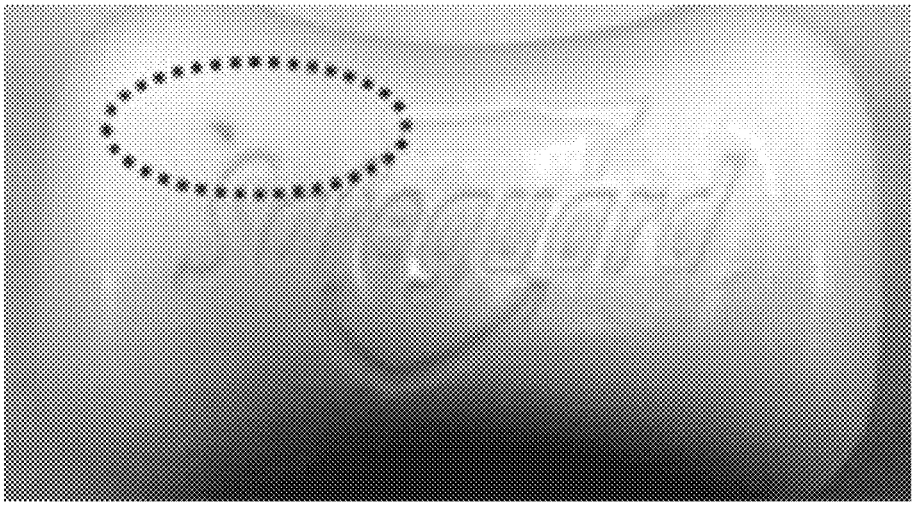
FIG. 2A is a photo of a ZPT-containing bar soap made using a metal blade of the prior art in the manufacturing process. The broken circle shows the discoloration on the surface of the bar soap due to the metal contamination.
Figure 2B:
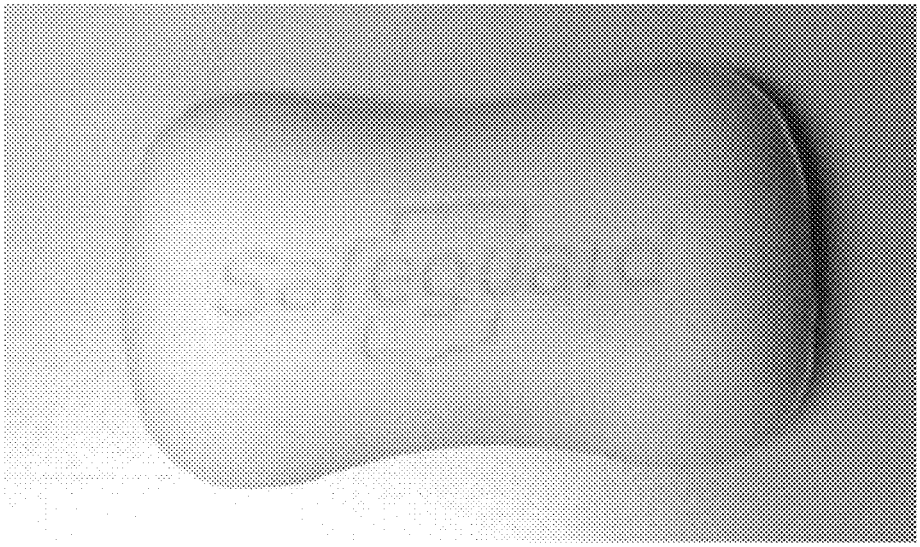
FIG. 2B is a photo of a ZPT-containing bar soap made using the polymer blade (10) of the present invention in the manufacturing process.

The present invention is directed to a manufacturing apparatus (1) for scraping soap adhered to a roll mill (100) for use in manufacturing bar soaps. It has been discovered that the manufacturing apparatus (1) in accordance with the present invention can be used to manufacture bar soaps that alleviate the discoloration problem seen with ZPT-containing bar soaps manufactured by the standard process with a metal blade (see FIGS. 1B, 2A & 2B). The discoloration problem occurs when metal ions such as, iron, complex with pyrithione forming a bidentate ligand. The complex is colored and detrimental to the soap appearance. This may be due to speciation, chelation and/or transchelation.

The surprising and unexpected discovery was that from the numerous potential sources of metal contamination that exist in the soap manufacturing process, it was the very brief contact between the metal blade and the ZPT-containing soap that causes the discoloration problem. Without intending to be bound by theory, it is believed that the ZPT-containing soap was most susceptible to reacting with the metal cations from the metal blade because of the violent nature of the scraping interaction and its occurrence immediately after the physical manipulation of the soap by the roll mills.

It has further been discovered that the manufacturing apparatus (1) of the present invention can be used to manufacture ZPT-containing bar soaps that exhibit substantially extended shelf-life. It is known that transition metals participate in oxidation of pyrithione, which results in long term loss of ZPT. Therefore, by replacing the metal blade with a non-metallic blade, a significant source of ZPT loss from contact with the metal blade can be eliminated. Thus, it will be evident that the invention can be used with any type of manufacturing process and machinery wanting to limit metal contact and/or contamination in the production of products, preferably bar soaps, and more preferably ZPT-containing bar soaps.

Another advantage of the present invention is that the manufacturing apparatus (1) can be used to produce compacted flakes of different thickness and/or density, as desired for manufacturing varying types of bar soaps, and/or other types of products.

Bar soaps can be made via a number of different processes known in the art. Typically, bar soaps are manufactured by a process that includes milling, resulting in milled bar soap. For example, a typical process for manufacturing a bar soap may comprise one or more of the following steps: (a) a step in which the soap is made through either a continuous process (ConSap or continuous saponification process) or a batch-making process (i.e., neutralization process for hydrolysis fatty acid noodle or kettle process), (b) a vacuum drying step in which the soap is made into soap noodles, (c) an amalgamating step in which the soap noodles are combined with other ingredients of the bar soap composition, (d) a milling step in which a relatively homogeneous mixture is obtained, (e) a plodding step in which the soap mixture is extruded as soap logs and then cut into soap plugs, and (f) a stamping step in which the soap plugs are stamped to yield the finished bar soap. Commonly, between steps (d) and (e) is when the metal scraper is used to scrape the soap adhered to the roll mill to form "compacted flakes". The compacted flakes is transferred to a conveyor belt and then to a plodder machine for further refining and extrusion.

The soap adhered to the roll mill is generally quite thin, for example, from about 0.2 mm to about 0.6 mm. The blade scrapes these thin flakes from the roll mill to form compacted flakes. It is evident that the manufacturing apparatus (1) can impact the thickness and/or density of the resultant compacted flakes. Those skilled in the art understand that the desired thickness and/or density of the compacted flakes will be determined by the constraints of the particular manufacturing process. For example, if the compacted flakes are too thin or not dense enough, then they may be too voluminous and clog up the conveyor belt or the hopper collecting them. Alternatively, if the compacted flakes are too thick or too dense, then they may be too heavy for processing. The thickness of the compacted flakes which is suitable for making bar soaps may be, for example, from about 8 mm to about 12 mm, preferably about 10 mm. Alternatively, the density of the compacted flakes which is suitable for making bar soaps may be, for example, from about 0.9 $g/cm^3$ to about 1.1 $g/cm^3$.

Figure 3:
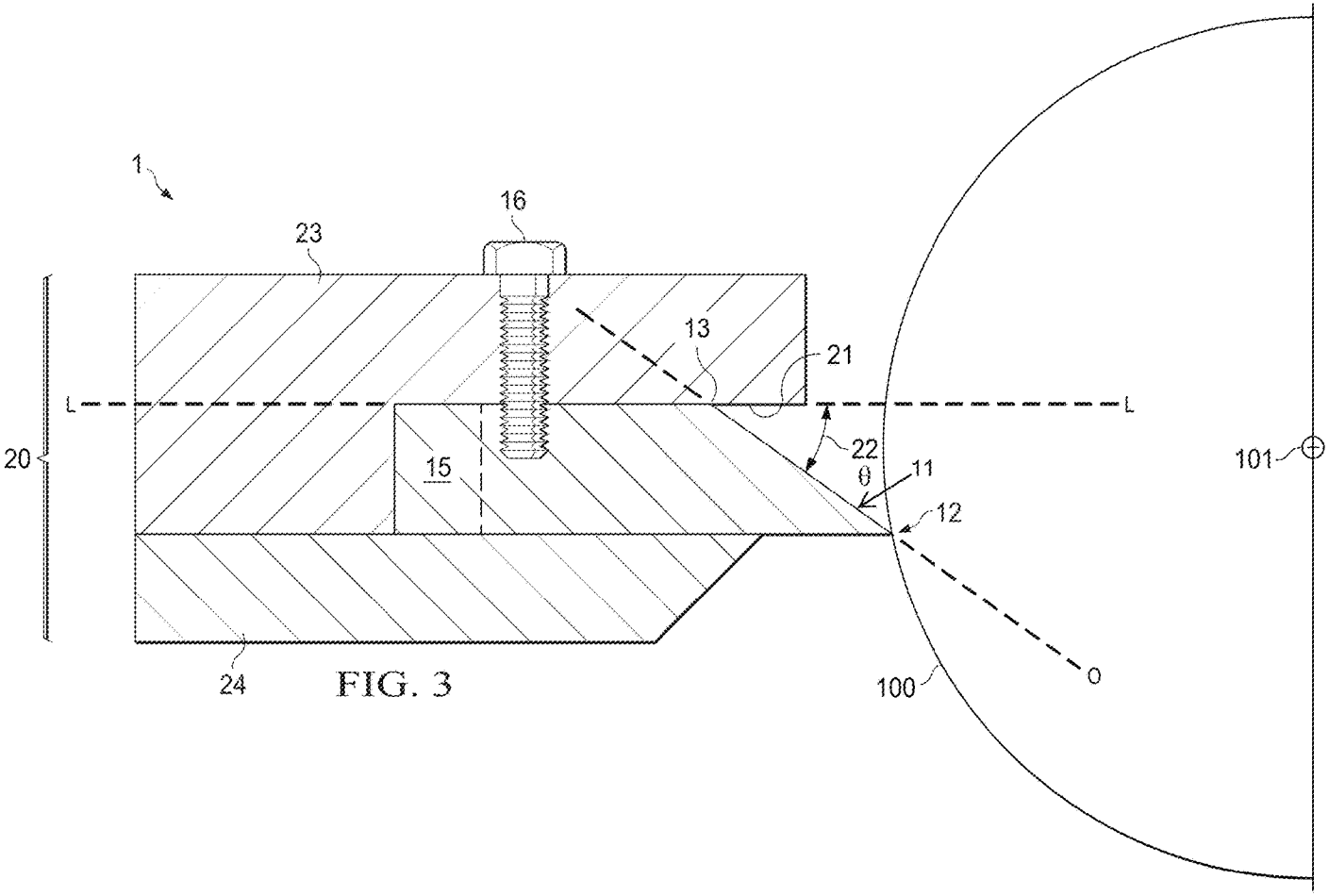
FIG. 3 is a cross-sectional view of an embodiment of the manufacturing apparatus (1) of the present invention in contact with a roll mill (100).

FIG. 3 shows an embodiment of the manufacturing apparatus (1) of the present invention. The roll mill (100) rotates about an axis of rotation (101) in a counter-clockwise direction relative to FIG. 3, and can be made of any standard material commonly used in the industry, including metal (e.g., stainless steel, carbon steel). In an embodiment, when the soap comprises ZPT, the roll mill (100) is preferably made of stainless steel. Of this embodiment, a preferred aspect is that the roll mill (100) is made of 400 series stainless steel due to its higher rigidity/hardness than the 300 series, even thou the 300 series tend to have better corrosion resistance. Without wishing to be bound by theory, it is understood that stainless steel is not as rigid as carbon steel, so therefore if a carbon steel blade is used then there would be a mismatch in the hardness of the metal hardness and resulting in frequent wear/erosion of the roll mill. This is a problem for an expensive roll mill, which would then have to be frequently replaced.

In another embodiment, when the soap comprises ZPT, the roll mill (100) is made from a non-metallic material, such as a polymer similar to the type used to make the polymer blade (10). The objective here is to further eliminate another source of metal contamination.

Specifically, the manufacturing apparatus (1) of FIG. 3 comprises: (i) a polymer blade (10), and (ii) a housing (20) that supports the polymer blade (10). The polymer blade (10) has a scraping surface (11) with a scraping edge (12) that contacts the surface of the roll mill (100). It will be evident that by the term "contact", it is meant to indicate that the surfaces of the polymer blade (10) and the roll mill (100) are in close proximity applying force to each other, and that the presence of a thin material layer (e.g., thin soap layer) which may intervene therein between does not imply that there is no contact.

The polymer blade (10) may be secured to the housing (20) by one or more holding elements (16) (e.g., screws), and wherein the polymer blade (10) is configured (e.g., recess or hole therein the polymer blade (10)) to receive the holding elements (16). With reference to FIG. 3, the scraping surface (11) may extend in a plane ("O") orthogonal with respect to an axis of rotation (101) of the surface of the roll mill (100). Preferably, the scraping surface (11) may have a distance from about 2 mm, 5 mm, 10 mm, or 20 mm to about 100 mm, 90 mm, 80 mm, or 70 mm, more preferably from about 5 mm to about 15 mm. The scraping surface (11) distance may be non-linear or linear, preferably a linear distance. However, other scraping surface (11) distances may be suitable and in part will, of necessity, have to relate to the dimensions of the other parts (i.e., compacting surface (21), facing angle (θ) (22)) of the manufacturing apparatus (1).

In another embodiment, the manufacturing apparatus (1) may be moveably mounted on a frame (not shown) so as to be moveable between a first operative position and a second, withdrawn, non-operative position. When the manufacturing apparatus (1) is in use, the frame may permit the housing (20) to position the polymer blade (10) so that its scraping edge (12) is contacting the surface of the roll mill (100). When not in operation, the frame may withdraw the housing (20) away from the surface of the roll mill (100) so as to avoid damaging the scraping edge (12).

In yet another embodiment, the housing (20) may comprise a top plate (23) for supporting the polymer blade (10). According to one aspect of this embodiment, the top plate (23) has a compacting surface (21) that is intersected by the scraping surface (11) at a point of intersection (13), wherein the intersection (13) is opposing the scraping edge (12). The compacting surface (21) and the scraping surface (11) forms a facing angle θ (theta) (22) of from about 30° to about 80° at the point of intersection (13). Specifically, the facing angle θ (22) may be from about 30°, 35°, 40°, 45°, 50°, or 55° to about 80°, 75°, 70 or 60°, preferably from about 40° to about 50°. According to another aspect of this embodiment, the housing (20) may further comprise a bottom plate (24) opposing the top plate (23) for sandwiching the polymer blade (10) thereinbetween.

In yet another embodiment, the compacting surface (21) may extend a distance of from about 6 mm to about 14 mm from the point of intersection (13) along a plane (L) relative to an axis (L) (102) of the housing (20). With reference to FIG. 3, the axis (L) (102) is an axis that is perpendicular to the axis of rotation (101) of the roll mill (100). According to this embodiment, the compacting surface (21) distance may be from about 6 mm, 7 mm, or 8 mm to about 14 mm, 13 mm, or 12 mm, preferably from about 9 mm to about 11 mm. In an embodiment, the distance may be non-linear or linear, preferably a linear distance. However, other distances may be suitable and in part will, of necessity, have to relate to the dimensions of the other parts of the manufacturing apparatus (1).

In another embodiment, the manufacturing apparatus (1) of the present invention having a ratio of a distance of the scraping surface (11) to a distance of the compacting surface (21) extending from the intersection along a plane (L) relative to an axis L (102) of the housing (20) is from about 1:1 to about 1:3, respectively.

It has importantly been found that the presence of this compacting surface (21) in the manufacturing apparatus (1) is responsible for compaction of the soap flakes scraped from the roll mill (100). Typically, a blade made from metal (e.g., carbon steel) is rigid and can be designed to be relatively thin (i.e., 0.8 mm to 1.2 mm). It is believed that the thin metal blade can act like a knife to scrape the adhered soap by facilitating the loss of adhesion at the surface of the roll mill (100). The compacted flakes formed by the metal blade appear to be of sufficient thickness and/or density so as to be suitable for manufacturing bar soaps.

Alternatively, a blade made from polymer has to be considerably thicker in order to achieve a comparable degree of rigidity. Given the different physical constraints, it is evident that the polymer blade cannot operate in the same manner as the metal blade. While not wishing to be bound by theory, it is believed that the manufacturing apparatus (1) of the present invention may plow off adhered soap on a roll mill (100) by blocking with a solid wall (i.e., compacting surface (21)). Accordingly, the compacting surface (21) of the top plate (23) acts as a blocking wall or weir to damn the scraped flakes and compresses them into compacted flakes of desirable thickness and/or density. It will be understood that the thickness of the compacted flakes can be influenced by changing the distance of the compacting surface (21). For example, longer compacting surfaces (21) should translate to thicker compacted flakes and vice-versa.

Figure 4:
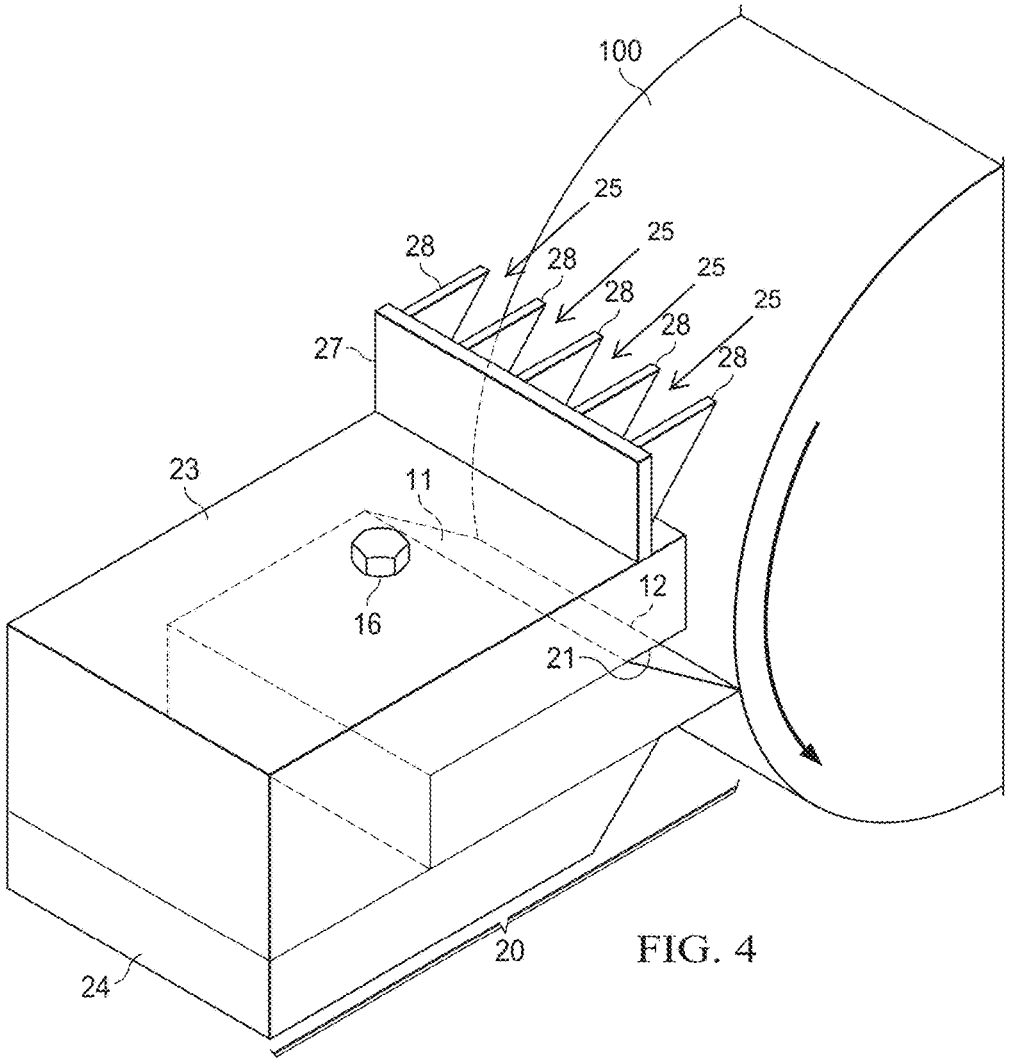
FIG. 4 is a perspective view of an embodiment of the manufacturing apparatus (1) of the present invention in contact with a roll mill (100) to form the compacted flakes.

FIG. 4 depicts a manufacturing apparatus (1) of the present invention in use. With reference to FIG. 4, the housing (20) may further comprise a plurality of channels (25) located at a proximate end (26) of the housing (20) configured to guide scraped soap coming off from the roll mill (100) to a conveyor belt (not shown). Typically, during use, the manufacturing apparatus (1) is positioned relative to the rotational axis (101) of the roll so that any compacted soap flakes scraped from the roll mill (100) is guided by the channels (25) towards the conveyor belt by gravity. This is intended to mean that the scraping edge (12) of the polymer blade (10) of the manufacturing apparatus (1) would normally be positioned towards the bottom of FIG. 4. With that arrangement, the thin soap material adhered to the roll mill (100) would be scraped off the surface of the roll mill (100). The scraped soap then travels over the scraping surface (11) of the polymer blade (10) and is compacted by the compacting surface (21) of the top plate (23) to form compacted soap flakes. The compacted soap flakes are push towards the channels (25) and fall towards the conveyor belt by gravity. However, as shown in FIG. 4, the manufacturing apparatus (1) has been rotated clock-wise approximately 70~90° to make it easier to view the various components of the apparatus (1).

The channels (25) may be defined by flanges (28) attached to a projection (27) that is substantially perpendicular to a plane (L) relative to an axis (L) (102) of the housing (20). Alternatively, the projection (27) may form any angle that is less than 90° to a plane (L) relative to an axis (L) (102) of the housing (20) so long as it does not cause the flanges (28) to interfere with the roll mill (100) during use. The flanges (28) may be attached equidistant from each other on the projection (27) to form equally spaced channels (25). Alternatively, the flanges (28) may be unevenly spaced from each other on the project so as to form channels (25) of different sizes.

In yet another embodiment, the present invention is directed to a manufacturing apparatus (1) for scraping soap adhered to a roll mill (100) comprising a polymer blade (10) having a scraping edge (12) contacting the surface of the roll mill (100), wherein the polymer blade (10) is made of a polymer selected from the group of polymer listed herein below. In a preferred embodiment, the polymer is a polyolefin selected from the group consisting of low density polyethylene, linear low density polyethylene, high density polyethylene (HDPE), polyolefin plastomers, thermoplastic polyolefins, and block co-polymers of ethylene and propylene. In a more preferred embodiment, the polymer is a thermoplastic polyolefin selected from a UHMW-PE (ultra high molecular weight polyethylene) or a cross-linked UHMW-PE (ultra high molecular weight polyethylene).

Polymer Blade

In another aspect, the present invention is directed to a polymer blade (10) for scraping soap adhered to a roll mill (100) comprising a scraping surface (11) extending from the scraping body (14) to a scraping edge (12) making contact with the surface of the roll mill (100), wherein the scraping body (14) has a thickness of from 3.5 mm to 18.0 mm.

Figure 5:
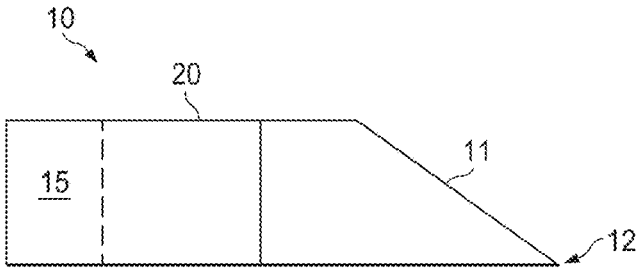
FIG. 5 is a cross-sectional view of an embodiment of the polymer blade (10) of the present invention.

In an embodiment, as shown in FIG. 5, wherein the scraping body (14) having a substantially rectangular shape configured to fit between the top (23) and bottom plates (24) of the housing (20). Alternatively, the scraping body (14) may have any desired shape, such as, for non-limiting example, square, triangle, or complexly shaped or contoured shaped. The shape of the scraping body (14) in part will, of necessity, have to relate to the dimensions of the housing (20), which it is complementary to, and constrained by the requirement that it forms a substantially snug fit within the housing (20). The housing (20) can be made from metal (e.g., stainless steel) or polymer. In order to minimize further metal contamination, the housing can preferably be made of a polymer similar to the type used to make the polymer blade.

In yet another embodiment, the inventors have found that the polymer blade (10) made of a polymer selected from the following group may be suitable for use in the present invention, wherein the group of polymers consisting of:

(a) PPSU (polyphenylene sulfone), PEI (poly(ether imide)), PSU (polysulfone), PC (polycarbonate), ABS (acrylonitrile butadiene styrene), ABS (acrylonitrile butadiene styrene), PVC (polyvinylchloride), PMMA (poly methyl methacrylate), PS (polystyrene), PPE/PPO (polyphenylene ether) or co-polymers thereof;

(b) PAI (poly(amide-imide), PPS (poly(phenylene sulfide), PEEK (poly(ether-ether ketone), PEKK (poly (ether ketone ketone)), PBI (polybenzimidizole), PEK (poly(ether ketone), or co-polymers thereof;

(c) PFA (per fluoro alkoxy alkane), MFA (co-polymer of TFE tetra fluoro ethylene and PFVE perfluorinated vinyl ether), FEP (Fluorinated ethylene propylene polymers), ECTFE (ethylene chloro trifluoro ethylene), PVDF (polyvinylidene fluoride), PTFE (polytetrafluoroethylene such as Teflon), or co-polymers thereof;

(d) PP (polypropylene), PE (polyethylene), LDPE (low density polyethylene), or co-polymers thereof;

(e) PET (polyethylene terephthalate), PA (polyamide), or co-polymers thereof;

(f) Poly(ether sulfone), Poly(aryl sulfone), polyphenylenes, polybenzoxazoles, polybenzthiazoles, or co-polymers thereof;

(g) Cross-linked polyurethanes, cross-linked thiol-ene polymers, cross-linked thiol-ene acrylate polymers, or co-polymers thereof;

(h) POM (polyacetal), Polyolefin, or co-polymers thereof; and (i) Blends of (a)-(g).

Of this embodiment, the polymer is preferably POM (polyacetal), polyolefin or co-polymers thereof. Of this embodiment, preferably the polymer is a polyolefin selected from the group consisting of low density polyethylene, linear low density polyethylene, high density polyethylene (HDPE), polyolefin plastomers, thermoplastic polyolefins, and block co-polymers of ethylene and propylene. Even more preferably, the polymer is a thermoplastic polyolefin selected from a UHMW-PE (ultra high molecular weight polyethylene) or a cross-linked UHMW-PE (ultra high molecular weight polyethylene), preferably cross-linked UHMW-PE. It is believed that UHMW-PE derives durability against wear from its high molecular weight (~$5\times10^6$ Daltons). Further, while cross-linking of UHMW-PE is not required, it is preferred because the cross-linking is believed to allow for increased durability of the resultant polymer blade (10).

In addition to thermoplastics polyolefins, there are other polymers that have similar properties that would be suitable for use in the preset invention. In yet another embodiment, the inventors have also found that the polymer blade (10) can be made of a polymer selected from thiolenes, urethanes (i.e., polythiolene, polyurethane), or co-polymers thereof. These polymers may be treated after polymerization to produce polymers of the cured resin type. For example, these polymers can undergo UV curing to produce a denser polymer material with similar properties to the cross-linked UHMW-PE blade.

It will be clearly evident that a blade made from metal, such as carbon steel or stainless steel, has a relatively high rigidity and therefore can be relatively thin. The rigidity of a material is a function of its thickness and inherent modulus of elasticity (i.e., tensile strength). Metals and polymers have a different moduli of elasticity. Therefore, it goes without saying that by switching materials, the thickness of the polymer blade (10) would have to increase to achieve the same rigidity of the metal blade in order to function in the same manner. In an embodiment, the inventors have found that the polymer blade (10) can provide comparable rigidity to the metal blade, if the scraping body (14) has a thickness of from about 3.5 mm, 4.0 mm, 4.5 mm, 5.0 mm to about 18.0 mm, 17.5 mm, 17.0 mm, or 16.0 mm, or preferably from about 13.5 mm to about 15.5 mm.

In yet another embodiment, the polymer blade (10) of the present invention may be made from a reinforced polymer. An example of a reinforced polymer may be any polymer as described herein which has been reinforced with a material having higher tensile strength (e.g., metal) than the polymer itelf. It could be imagine that the metal component could be formed on the inside while the polymer forms a coating on the outside of the blade.

In yet another embodiment, the the polymer blade (10) of the present invention wherein the blade (10) is made from a polymer that provides for lower wear rate (i.e., long blade life). In particular, the inventors have discovered that polymer blade (10) made form UHMW-PE having a thickness greater than 3.5 mm, preferably, greater than 4.0 mm, and more preferably greater than 6.0 mm, can provide comparable tensile strength and/or rigidity to a metal blade.

In yet another embodiment, without being constrained by the particular shape as shown in FIG. 5, the inventors have found that the polymer blade (10) may be suitable for use in the present invention if it is made of a polymer having an elastic modulus (i.e., tensile strength) of from about 220 N/mm, 300 N/mm, or 350 N/mm to about 10,000 N/mm, 9,500 N/mm or 9,000 N/mm, or preferably from about 300 N/mm to about 8,000 N/mm, as determined according to ASTM D638-10. Without wishing to be bound by theory, it is believed that polymers having the elastic modulus within the specified ranges as disclosed hereinabove have sufficient ductility so that they will not crack or chip, for example, when dropped. Non-limiting examples of such polymers include polyolefins, specifically, thermoplastic polyolefin, and more specifically polyethylene, as described hereinabove.

In yet another embodiment, the polymer blade (10) may further comprise a top plate (23) mounted to the polymer blade (10), wherein the top plate (23) has a compacting surface (21) facing the scraping surface (11) forming a facing angle (θ) (22) from about 30° to about 80°. Of this embodiment, preferably the facing angle (θ) (22) is 40° to 50°. In yet another embodiment, the polymer blade (10) may further comprise a bottom plate (24) opposing a top plate (23) for sandwiching the polymer blade (10) thereinbetween.

In yet another embodiment, the inventors have discovered a relationship between the distance of the compacting surface (21) and the distance of the scraping body (14) of the polymer blade (10) that provides for the optimal design. Specifically, wherein a ratio of a distance of the compacting surface (21) relative to a distance of the scraping body (14) is from 1:4 to 1:8, respectively, wherein the distances are measured along a plane (O) orthogonal relative to an axis of rotation (101) of the roll mill.

In yet another embodiment, the polymer blade (10) wherein the scraping body (14) may extend a distance from about 20 mm, 25 mm, or 30 mm to about 112 mm, 107 mm, or 102 mm, preferably from about 25 mm to about 35 mm, along a plane (L) relative to an axis L (102) of the housing (20).

In yet another embodiment, the polymer blade (10) wherein the compacting surface (21) may extend a distance of from 6 mm to 14 mm, preferably from 9 mm to 11 mm, along a plane (L) relative to an axis L (102) of the housing (20).

Process for Manufacturing Bar Soap

In another aspect, the present invention is directed to a process for manufacturing a bar soap, wherein the process comprises the steps of:

(a) mixing ingredients of a soap in a mixer,
(b) milling the ingredients over one or more roll mill;
(c) scraping the ingredients adhered to the roll mill with a manufacturing apparatus according to the present invention; and
(d) extruding the ingredients into the bar soap.

In an embodiment, the process as described above in which in step (b) the speed of the scraped roll mill is maintained in the range of from about 2 m/s to about 4/s. In another embodiment, the process as described above in which the pH is generally maintained in a range from between about 10.0 to about 10.5.

Bar Soap

The ZPT-containing bar soaps of the present invention have demonstrated anti-microbial and enhance color stability properties. In order to achieve these benefits, the manufacturing apparatus of the present invention has replaced the standard metal blade commonly used in the industry to manufacture bar soaps with a polymer blade (10).

In an embodiment, the present invention provides for a bar soap comprising about 0.11 wt % to 0.28 wt % of ZPT prepared by the process as described above. In an embodiment, the bar soap made by the process of the present invention shows no discoloration according to the Stability Test as disclosed herein.

In another embodiment, the bar soap of the present invention has a "low" pH. The "low" pH preferably is in the range of from about 10.0 to about 10.5. As used herein, pH of the present bar soap can be measured at around 25° C. using any commercially available pH meter. The bar soap is first dissolved in distilled water at 50° C. and then agitated for 2 hours in a sealed cup to avoid absorbing carbon dioxide, to form an aqueous solution of a concentration of 1.0%. The solution is cooled down to 25° C. and then the pH is measured.

The pH of the ZPT-containing bar soap may be important since it can have an impact on the processing, metal absorption, oxidation, discoloration, etc. of the bar soap. For example, while low pH bar soaps are better for ZPT stability, low pH bar soaps tend to discolor considerable more so this tends to be a problem specific for ZPT-containing soaps. As a result ZPT-containing bar soaps with low pH necessitate the use of non-metal blades, preferably polymer blades (10) of the present invention, and preferably in combination with stainless roll mills. It is possible to manufacture ZPT-containing bar soaps at higher pH (e.g., 10.7) and use chemical means such as, $ZnCO_3$ (see US2012/0220516 (P&G)), to help fix the discoloration problem. However, due to ZPT instability at the higher pH, manufacturers are forced to the lower pH ranges of between about 10.0 to about 10.5 for the ZPT-containing bar soaps, and thereby requiring the use of the polymer blade of the present invention for their manufacture if avoidance of the above described issues is desired.

In order that the invention described herein may be more fully understood, the following test methods are set forth. It should be understood that these methods are for illustrative purposes only and are not to be construed as limiting this invention in any manner.

Test Methods

1. Load Deflection Test

The Load Deflection Test method measures the deflection of the material as a function of the load in force applied (N)/by the distance displaced (mm). This test provides a means for determining the stiffness or rigidity of a material. The method measures the bending of a material by mimicking the placement of a range of varying loads onto the material, and then measuring the distance the material moved attributed from the load. For example, the load deflection for a scraper made from a metal can be determined. Next, the load deflection for a scraper made from a plastic can be determined. Once the load deflection for a plastic material has been determined, then the data can be used to determine the approximate thickness that is required of the plastic material in order to obtain the comparable rigidty of a metal material.

Figure 8:
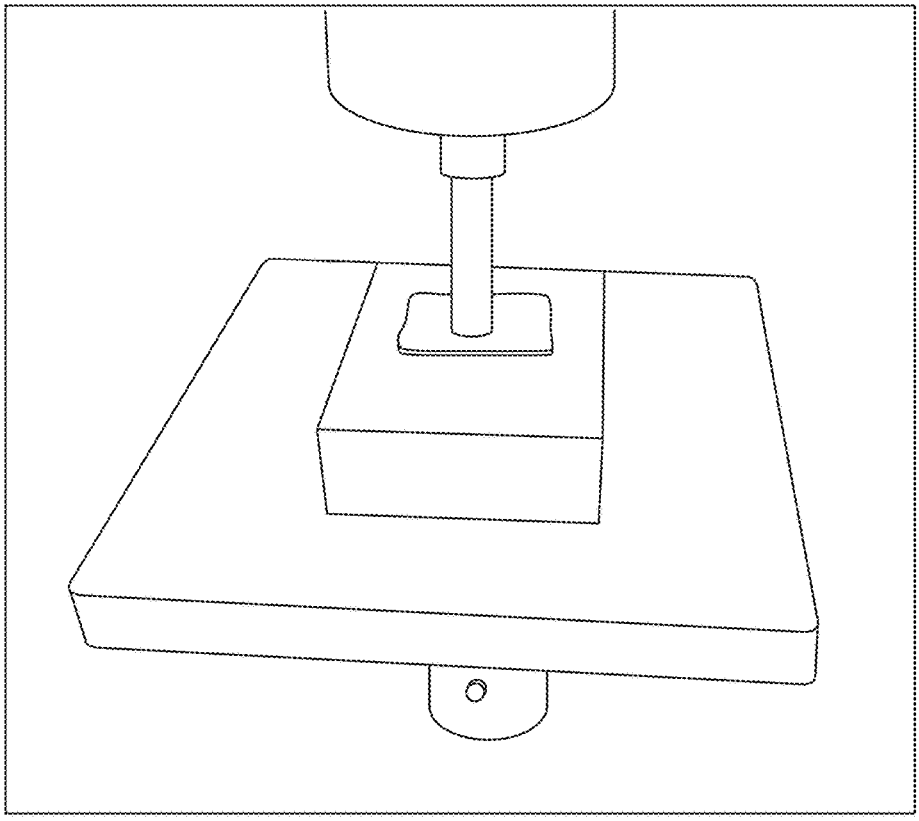
FIG. 8 is a photo of a test equipment for measuring the load deflection (K) of the blades.

One way to conduct the load deflection test is to place a 70 mm×16 mm piece of a test material on a beam plate as shown in FIG. 8. The deflection tester (available from Instron, USA) consists of a probe (10 mm in diameter) that contacts the center of the test material. Testing begins by the deflection tester applying a force (N) via the probe onto the test material and recording the distance displaced (mm) at the center of the test material. The test is repeated with higher forces being applied at the center of the test material until just before it is totally bent (i.e. yield point). Each test material undergoes the same process. The load deflection rate (K) is calculated as the load (N)/deflection (mm) before the yield point.

2. Wear Rate Test

The Wear Rate Test serves as an accelerated aging test to assess the wear characteristic of a particular type of material under severe conditions over time in use on the roll mill.

1. Prepare the test samples of the blade from the different materials having the general shape as depicted in FIG. 5 (approx. 1,000 mm length×50 mm width).
2. Record the initial weight (g) and width (mm) of each blade.
3. Start the test by placing the blade in contact with the roll mill running at speed of 2.12 m/s. Allow the roll mill to run continuously for 1-2 days (avg. approx. 1,000 to 2,000 mins).
4. Stop the roll machine and remove the blade.
5. Record the end weight (g) and width (mm) of each blade.
6. Calculate the width loss (um/km) and weight loss (mg/km) as representative of the blade wear rate.
7. Repeat steps 3 to 6 for each sample blade.

3. Discoloration Test

As used herein, "discoloration" means the color change brought by formation of colored precipitates from a reaction between ZPT and unwanted metal ions, such as ferric ions and/or cupric ions. The discoloration can be in a color of grayish blue, blue, black, purple, green, and the like, which is different from the original color (i.e., white) of a composition comprising ZPT. By "original color", it means the color of the composition before ZPT in the bar soap has an opportunity to react with ferric and/or cupric ions. For ease of measurement and comparison, discoloration in bar soaps herein is artificially induced by adding solutions containing ferric and/or cupric ions, and the color difference in the bar soaps before and after the artificial introduction of ferric and/or cupric ions can be readily measured either by employing an expert panel trained for conducting discoloration evaluation or quantitatively by using a colormeter or other well known equipment.

For example, a Wet Iron Plate method can be used to artificially induce ZPT discoloration in bar soaps. Specifically, cast iron plates are chosen as the ferric source to react with the pyrithione ions to induce discoloration. Before testing, the cast iron plates are polished to make sure that there is no rust on the surface. Then, the cast iron plates and the bar soaps to be tested are washed under running tap water for 5 minutes. Then, the wet bar soaps are carefully placed on the wet cast iron plates to ensure sufficient contact between the bar soaps and the surfaces of the cast iron plates. The bar soaps are kept on the cast iron plates for 2 hours before they are removed. Resulting discoloration on the bar soaps is then evaluated by a panel of 6 panelists who grade the discoloration according to the discoloration score table shown in FIG. 6.

Alternatively, a Ferric Ion Discoloration Threshold method can be used to evaluate the resistance of bar soap compositions against ferric ion-induced discoloration. The "threshold" means the minimum level of undesirable metal ions for causing measurable color change in ZPT bar soap, which can be determined by a tangential extrapolation process as described hereinafter.

Specifically, when a bar soap composition is ready to be tested for discoloration threshold, it is processed into multiple sample bar soaps. A circular surface area with a diameter of 23.50 mm is marked on the surface of each sample bar soap. Such a circular surface perfectly matches the diameter of a probe in a Gretag-Macbeth™ Color-Eye 3100 colormeter, which is employed in the present invention to measure the color LAB values of the sample bar soaps before any discoloration was induced by introduction of ferric ions ("Standard Color").

Subsequently, a series of freshly prepared $FeCl_3$ solutions containing 0.0029 wt %, 0.0058 wt %, 0.0087 wt %, 0.0116 wt %, 0.0174 wt %, 0.0232 wt %, and 0.0290 wt % of $FeCl_3$ are separately titrated onto the marked circular surface areas of seven (7) sample bar soaps made from the same bar soap composition to be tested, so as to intentionally induce discoloration therein. The volume of each $FeCl_3$ solution on each circular surface area is well controlled to be 60 μL. Therefore, the levels of $Fe^{3+}$ ions titrated onto the sample bar soap surfaces are 8.1 ppm, 16.1 ppm, 21.2 ppm, 28.3 ppm, 42.4 ppm, 56.5 ppm, and 70.7 ppm, respectively.

After being placed under room temperature for 2 hours, various degrees of discoloration will develop on the top layer of the sample bar soaps within the marked circular surface area where the $FeCl_3$ solutions are titrated.

The marked circular surface area is then analyzed by the Gretag-Macbeth™ Color-Eye 3100 colormeter to determine the LAB color values of the discoloration induced by addition of the $FeCl_3$ solution ("Sample Color"). The colors are hereby quantified by the well-known LAB values. Specifically, the L value represents the lightness or brightness of the color measured, i.e., the higher the L value, the lighter or brighter the color. The A value represents the redness/greenness of the color measured, with positive A values stand for red colors and negative A values stand for green colors. The B value represents the yellowness/blueness of the color measured, with positive B values stand for yellow colors and negative B values stand for blue colors. When comparing the difference between a Sample Color and a Standard color, a positive Delta L (ΔL), which is calculated as =LSample−LStandard, indicates that the Sample Color is lighter than the Standard Color, and a negative ΔL indicates that the Sample Color is darker than the Standard Color. A positive Delta A (ΔA), which is calculated as =ASample−AStandard, indicates that the Sample Color is redder, and a negative ΔA indicates that the Sample Color is green. A positive Delta B (ΔB), which is calculated as =BSample−BStandard, indicates that the Sample Color is yellower, and a negative ΔB indicates that the Sample Color is bluer. The more negative ΔB is, the more blue the Sample Color is in comparison with the Standard Color.

By plotting the measured ΔB values (y axis) against the titrated ferric levels (x axis) of the tested bar soap composition on a graph, a discoloration curve for the tested bar soap composition can be obtained. The minimum level of ferric ions needed for causing measurable blue color change in such tested bar soap composition can then be determined by extrapolation, i.e., by drawing a tangential line along the steepest portion of the discoloration curve plotted for the tested bar soap composition and extrapolating the tangential line to intersect with the x axis of the graph. The x value (i.e., the ferric level) that corresponds to the intersection point is then identified as the ferric ion discoloration threshold.

4. ZPT Stability

As mentioned hereinabove, ZPT may undergo transformation upon exposure to oxidizing species, thereby losing its anti-microbial effect over time in environments susceptible to oxidation. Such vulnerability of ZPT to environmental assaults is well known in the art, and various solutions have been proposed to stabilize ZPT with limited success.

The chemical stability of ZPT is evaluated by an aging test described as follows, so as to determine the percentage loss of ZPT after such aging test. First, a bar soap containing ZPT is obtained, preferably immediately after it is manufactured. The starting content of ZPT in such bar soap (in percentage) is measured by method described hereinafter using a portion of the bar soap, or a companion bar made from the same batch of soap noodle. The bar soap is weighed (+/−0.01 g), and its starting weight is recorded. Second, the bar soap is subjected to an aging process, during which the bar soap is placed inside a sealed water impermeable bag, which is preferably made of polyethylene (PE). The bag containing the bar soap is then left either at room temperature (i.e., about 25° C.), or in a convection oven at an elevated temperature (e.g., 50° C.), for an extended period (e.g., 10 days, 12 days, 14 days, or up to 36 months in certain cases). After the aging, if placed in a convection oven at the elevated temperature, the bar soap is taken out of the convection oven and allowed to return to room temperature (i.e., 25° C.). The bar soap is weighed again, and its final weight is recorded. The final content of ZPT in the bar soap (in percentage) is measured by the same method as described hereinafter.

Chemical stability of the ZPT is calculated by the following equation to obtain the percentage loss of ZPT:

$$\%\ \text{Loss of } ZPT = \left[1 - \frac{\text{Final Bar Weight} \times \text{Final } ZPT \text{ Content (\%)}}{\text{Starting Bar Weight} \times \text{Starting } ZPT \text{ Content (\%)}}\right] \times 100\%,$$

The content of ZPT in bar soap compositions is measured herein by an iodine-based titration method, which is described in greater detail in the following sections. The mercapto group in ZPT can be titrated by iodine, which oxidizes it to the disulfide-2,2' dithiobispyridine-1-oxide. If ZPT has already been oxidized or undergone transformation otherwise so that it no longer possesses the mercapto group, it will not be detectible by the iodine-based titration method described hereinafter.

First, a standardized 0.04 N iodine solution is prepared. Specifically, anhydrous sodium thiosulphate (with a minimum purity of 99%) is oven-dried for 2 hours at 105° C. and then stored in a dessicator. 0.05 g (+/−0.0001 g) of the anhydrous sodium thiosulfate is weighed and placed into the 100 mL polypropylene beaker of an autotitrator, and 50 mL of deionized water is added to form a standard solution. The autotitrator used herein is preferably a Mettler DL25 or Mettler DM140-SC titrator with platinum ring electrode, which is commercially available from Mettler Toledo Internantional, Inc. (Switzerland), or an equivalent thereof. The autitrator is set up to titrate the standard sodium thiosulfate solution with the iodine solution that is being standardized. Bubbles are eliminated from the burette of the autotitrator, and titration is commenced. Such procedure is repeated twice more, and the results are averaged to obtain a standardized 0.04N iodine solution. The % relative standard deviation (RSD) should be less than 1% of the average.

Next, standardized 0.01 N and 0.006 N iodine solutions are prepared. Specifically, standardized 0.01 N iodine solution is prepared using 0.10 g (+/−0.0001 g) sodium thiosulphate dissolved in 100 mL deionized water, using 10.0 mL pipetted into the 100 mL autotitrator breaker with 50 mL additional deionized water followed by the titration procedure. Standardized 0.006 N iodine solution is prepared using 3.0 mL of a 0.01 M sodium thiosulphate solution and 40 mL of a solvent (containing 13% v/v hydrochloric acid in 6% v/v butanol), followed by addition of 40 mL of 1:1 hexane/isopropanol. The autotitration procedure is subsequently carried out. The iodine solutions are standardized daily.

The bar soap whose ZPT content is to be measured is then shredded using a grater and stirred to form a homogenous mixture. 4.00 g of the shredded soap is weighed and put into a clean, dry beaker of an autotitrator. 75 mL of hot 6% v/v butanol (which was heated in a boiling-water bath) and 5 mL of concentrated HCl (provided at room temperature) are then added into the beaker. The mixture is agitated vigorously so as to fully dissolve all soluble components. The beaker is subsequently placed in the autotitrator, and bubbles are completely eliminated from the burette.

The titration is then initiated and analyzed while the mixture is still warm. The mixture is vigorously agitated during the titration procedure. For compositions with less than 0.2% of ZPT by weight, titration is carried out using the 0.006 N iodine solution. For compositions with higher ZPT concentrations, the initial starting sample weight can be reduced. Titration can be done either manually or by using autotitration procedure by those with skill in the art.

The ZPT content in the bar soap is calculated as follows:

$$ZPT \text{ Content (\%)} = \frac{\text{Volume of Iodine Solution(ml)} \times \text{N} \times 15.88\%}{\text{Sample Weight } (g)},$$

wherein N is the normality of the standardized iodine solution, and wherein 15.88% is a constant that is derived from:

$$15.88\% = \frac{\text{Molecular Weight of } ZPT \times 100\%}{\text{Number of Pyrithione per Molecule} \times 1000\,\text{ml/Liter}} = \frac{371.6 \times 100\%}{2 \times 1000\,\text{ml/Liter}},$$

The above-described procedure is repeated three times for each bar soap composition whose ZPT content is to be measured, and the results are averaged to obtain a final ZPT content in percentage (%) for the specific bar soap. All chemical reagents employed hereinabove are high-purity reagents obtained from VWR Scientific (Batavia, Ill., USA) or other scientific chemical suppliers.

EXAMPLES

Example 1

Preparation of Polymer Blades

Polymer blades of the present invention were made from a variety of plastic materials and with a varying range of thickness (for the scraping body (14)) according to the embodiment depicted in FIG. 5, and summarized in Table 1.

TABLE 1

| | Polymer | Density (g/cm$^3$) | Thickness (mm) of the Scraping Body |
|---|---|---|---|
| Example 1 | UHMW-PE* | 0.93 | 3.0 |
| Example 2 | UHMW-PE* | 0.93 | 4.0 |
| Example 3 | UHMW-PE* | 0.93 | 6.0 |
| Example 4 | HDPE** | 0.96 | 3.0 |
| Example 5 | POM*** | 1.41 | 3.0 |

*Commercially available as Tivar ® 1000 from Quadrant Engineering Plastic Products (Beijing, China).
**Commercially available as PE 500 from Quadrant Engineering Plastic Products (Beijing, China).
***Commercially available as Ertacetal ® C from Quadrant Engineering Plastic Products (Beijing, China).

Example 2

Load Deflection of Polymer Blades Vs. Metal Blades

A comparative experiment was carried out to assess the load (N)/deflection (mm) rate of polymer blades made according to Example 1 in comparison to 1.0 mm metal blades. The following two comparative metal blades were prepared according to the embodiment depicted in FIG. 5, and their details are summarized in Table 2.

TABLE 2

| | Metal | Density (g/cm$^3$) | Thickness (mm) of the Scraping Body |
|---|---|---|---|
| Example 6 | Carbon Steel* | 7.8 | 1.0 |
| Example 7 | 304 Stainless Steel** | 7.9 | 1.0 |

*Commercially available as 65Mn carbon steel from JiaDong (Tianjin, China).
**Commercially available as SS304 from JiaDong (TianJin, China).

The load deflection for Examples 1-5 (i.e., the polymer blades of the present invention) and Examples 6-7 (i.e., the metal blades) were measured according to the procedures described hereinabove. The measurement results are summarized in Table 3.

TABLE 3

| | Ex. 1 UHMW-PE (3 mm) | Ex. 2 UHMW-PE (4 mm) | Ex. 3 UHMW-PE (6 mm) | Ex. 4 HDPE (3 mm) | Ex. 5 POM (3 mm) | Ex. 6 CS (1 mm) | Ex. 7 304SS (1 mm) |
|---|---|---|---|---|---|---|---|
| Max Load (N) | 69 | 146 | 391 | 108 | 281 | 721 | 343 |
| Deflection at Max Load (mm) | 9.78 | 7.73 | 8.31 | 7.84 | 7.34 | 5.69 | 6.49 |
| Load at Yield Point (N) | 40 | 100 | 100.5 | 74 | 200 | 590 | 200 |
| Deflection at Yield Point (mm) | 3.05 | 2.46 | 0.48 | 2.67 | 2.72 | 2.59 | 0.66 |
| Load Deflection (K) (N/mm) | 13.1 | 40.7 | 209.4 | 27.7 | 73.5 | 227.8 | 303.0 |

Figure 6:
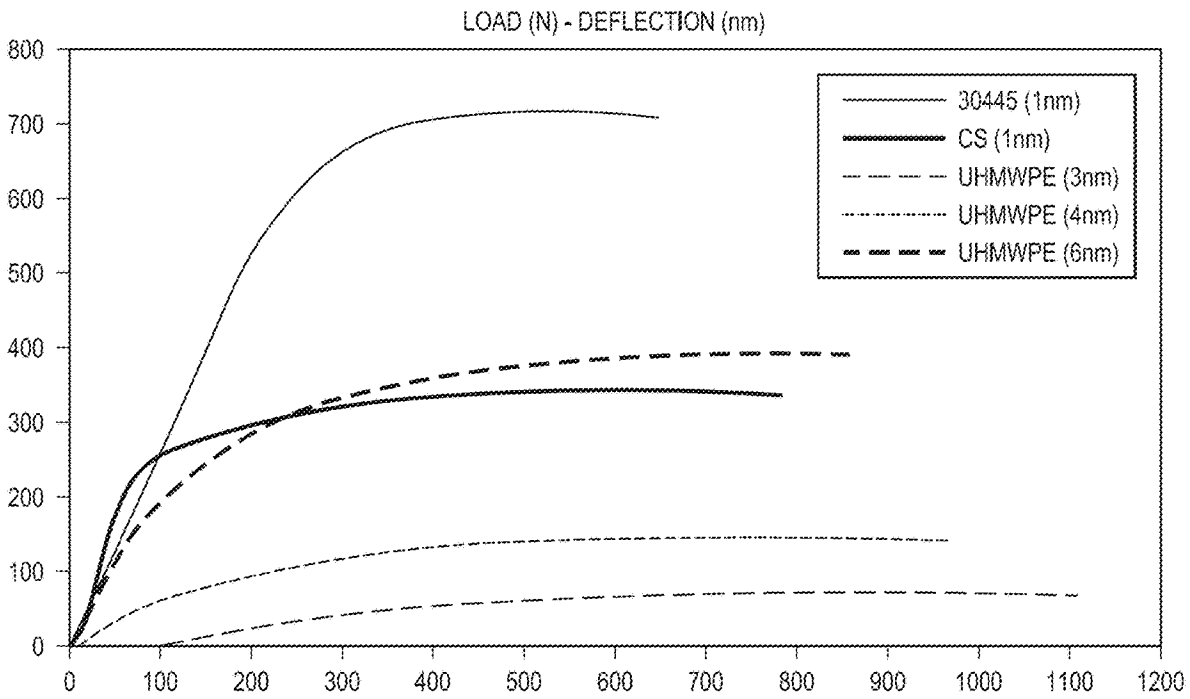
FIG. 6 is a graph depicting load deflection (K) curves for polymer or metal blades.
Figure 7:
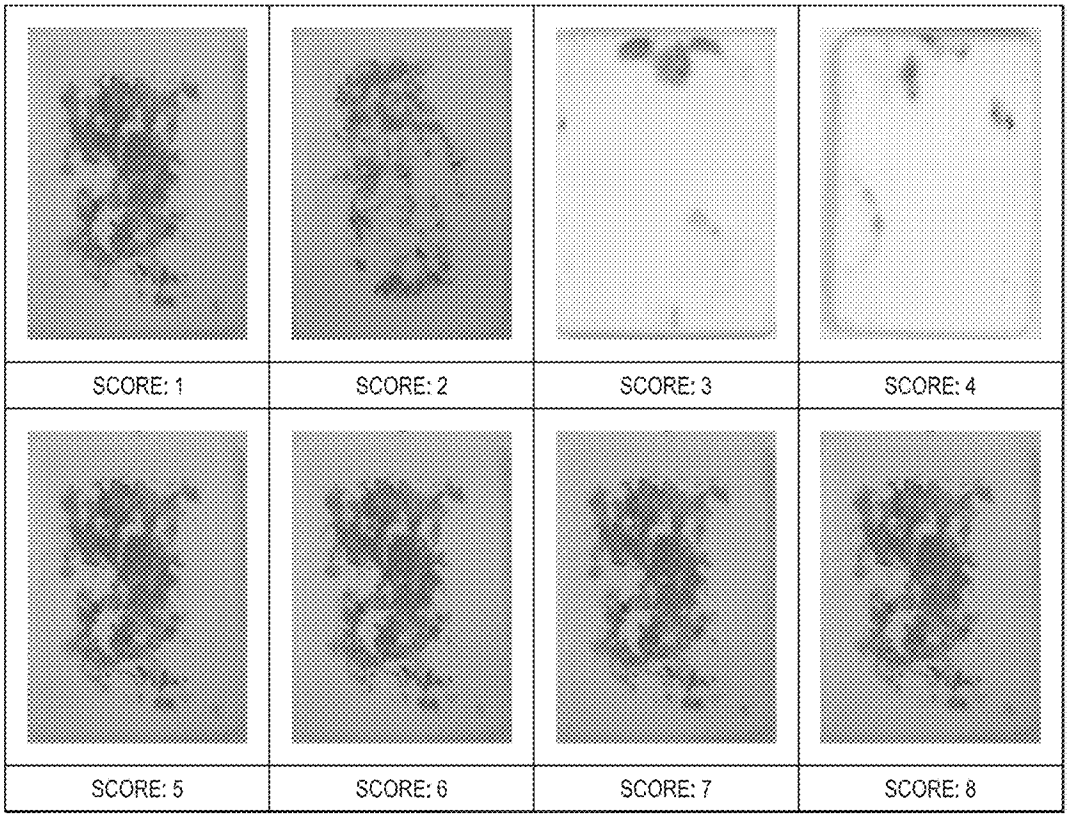
FIG. 7 is a discoloration score table showing pictures of 8 different bar soap samples containing ZPT with discoloration scores ranging from 1 (most discolored) to 8 (least discolored), which can be used for panel evaluation of ZPT discoloration in exemplary and comparative bar soap compositions.

The data was analyzed and graphed using Microsoft Excel. FIG. 6 shows the load deflection curves of Examples 1-7 as measured by the load deflection test. It is clear from FIG. 6 that the load deflection (K) for the carbon steel of Example 6 is significantly greater than for blades made from the polymers having less than 3 mm thickness. However, as you increase the thickness of the blade made from UHMW-PE, then the load deflection (K) approaches a comparable level to that of the carbon steel of Example 6. In fact, load deflection (K) of the UHMW-PE blade of 6.0 mm thickness of Example 3 is almost equal to that of the carbon steel of Example 6. Therefore, a sufficient tensile strength was observed for polymer blade made from UHMW-PE having certain a thickness.

Example 3

Wear Rate Study

Four different blades were prepared. Specifically, Example 8 is a comparative example made from carbon steel, and Examples 9-11 are inventive examples made from UHMW-PE, POM, and HDPE, respectively. The Wear Rate Test was conducted as described hereinabove. The measurement results and calculated weight loss are summarized in Table 4.

TABLE 4

| | | Ex. 8 Carbon Steel | Ex. 9 UHMW-PE | Ex. 10 POM | Ex. 11 HDPE |
|---|---|---|---|---|---|
| Wear Rate | μm/Km | 0.3 | 0.1 | 7.3 | 3.7 |
| | Mg/Km | 9.65 | 0.00 | 21.76 | 8.96 |
| | Weight Loss (%) | 0.5% | 0.0% | 4.0% | 2.4% |

*The materials are obtained from the same supplier as described hereinabove.

The above examples demonstrated that polymer blades made from POM and HDPE have worse wear rate than metal blade made from carbon steel, but surprisingly polymer blade made from UHMW-PE showed better wear rate than the metal blade.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A manufacturing apparatus for scraping soap adhered to a roll mill comprising: (i) a polymer blade with a scraping surface having a scraping edge contacting the surface of the roll mill; and (ii) a housing supporting the polymer blade and having a compacting surface intersecting the scraping surface at an intersection, wherein the intersection is opposing the scraping edge, and wherein the compacting surface and scraping surface forms a facing angle θ from about 30° to about 80°.

2. The manufacturing apparatus according to claim 1, wherein the scraping surface has a distance of from about 5 mm to about 15 mm, and the compacting surface extends a distance of from about 6 mm to about 14 mm from the intersection along a plane (L) relative to an axis L of the housing.

3. The manufacturing apparatus according to claim 1, wherein a ratio of a distance of the scraping surface to a distance of the compacting surface extending from the intersection along a plane (L) relative to an axis L of the housing is from about 1:1 to about 1:3, respectively.

4. The manufacturing apparatus according to claim 1, wherein the housing further comprises a plurality of channels located at a proximate end of the housing configured to guide scraped soap.

5. The manufacturing apparatus according to claim 4, wherein each of the channels are defined by flanges attached to a projection that is substantially perpendicular to a plane (L) relative to an axis (L) of the housing.

6. The manufacturing apparatus according to claim 5, wherein the polymer is a polyolefin selected from the group consisting of low density polyethylene, high density polyethylene, polyolefin plastomers, thermoplastic polyolefins, and block co-polymers of ethylene and propylene.

7. The manufacturing apparatus according to claim 1, wherein the polymer is a thermoplastic polyolefin selected from a ultra high molecular weight polyethylene or a cross-linked ultra high molecular weight polyethylene.

* * * * *